United States Patent [19]

Foti

[11] Patent Number: 4,991,212

[45] Date of Patent: Feb. 5, 1991

[54] BROADCAST SIGNAL CONDITIONING METHOD AND APPARATUS

[76] Inventor: Frank Foti, 12540 Edgewater Dr. #1206, Lakewood, Ohio 44107

[21] Appl. No.: 433,760

[22] Filed: Nov. 9, 1989

[51] Int. Cl.[5] ..... H04H 5/00

[52] U.S. Cl. ..... 381/14; 381/97; 455/43

[58] Field of Search ..... 381/14, 16, 3, 97, 98; 455/42, 43, 110, 113; 332/123

[56] References Cited

U.S. PATENT DOCUMENTS 3,989,897 11/1976 Carver ..... 381/94

FOREIGN PATENT DOCUMENTS 478443 1/1976 U.S.S.R. ..... 455/43

*Primary Examiner*—Jin F. Ng
*Assistant Examiner*—Sylvia Chen
*Attorney, Agent, or Firm*—Watts, Hoffmann, Fisher & Heinke

[57] ABSTRACT

A signal conditioning circuit for use in broadcasting a composite stereo signal in the 50 hertz to 53 kilohertz range. The signal conditioning circuit includes a filter for attenuating signals above the 53 kilohertz range, a delay circuit to reduce frequency dependent distortion caused by the filter, and an amplitude limiting circuit to reduce filter introduced amplitude distortion. Use of the signal conditioning circuit results in better utilization of the radio station's allocated transmission frequency and allows subchannel carrier authorization (SCA) use of the modulation frequency range above 53 kilohertz.

13 Claims, 8 Drawing Sheets

BROADCAST SIGNAL CONDITIONING METHOD AND APPARATUS

FIELD OF THE INVENTION

The present invention relates to broadcasting radio signals and more particularly to a method and apparatus for conditioning radio broadcast signals to improve their quality.

BACKGROUND ART

When a radio station obtains a broadcasting license from the Federal Communications Commission (FCC) the radio station is allocated a specific frequency range in which it is authorized to transmit to the public. The FCC allocates each FM station a frequency band for transmitting its signals that is 200 kilohertz wide. The radio station typically designates the center of its allotted frequency range as "the" frequency at which it transmits for tuning purposes. A typical FM radio station, for example, might advertise that it broadcasts at 100.1 megahertz. Deviations above and below this center, carrier frequency encode information onto the FM signal. The FCC allotted frequency range for an FM radio station extends 100 kilohertz above and below the 100.1 megahertz carrier frequency.

FM stations that allocate large portions of their on air time to music typically broadcast stereophonically due to the commonly accepted notion that music sounds better when it is heard in stereo. Stereo broadcasting is accomplished by combining the right and the left channel audio content into the transmitted signal and then decoding the transmitted signal at the radio receiver.

A standardized system of FM stereo broadcast signal encoding has developed using a 53 kilohertz frequency band that is used to modulate the carrier signal. The 53 kilohertz band contains three distinct signals which are known as the "composite stereo signal". A left channel plus right channel stereo signal is assigned to a frequency range from 50 hertz to 15 kilohertz. A second range from 23 kilohertz to 53 kilohertz is occupied by the left minus right stereo signal. A pilot tone is generated at a frequency of 19 kilohertz.

The composite stereo signal is combined with the carrier signal (100.1 megahertz for example) by an FM exciter and fed to a signal transmitter which generates a broadcast signal and transmits this broadcast signal to a broadcast antenna. When a remotely located radio tuner receives this stereophonically encoded broadcast signal, tuner circuitry extracts the right and left channel signals from the transmitted composite stereo signal and converts this signal to an audible frequency signal which drives the radio speaker or speakers through an amplifier. The theory of encoding stereo separation information within a 53 kilohertz frequency band is disclosed in U.S. Pat. No. 3,257,511 to Adler et al., issued June 21, 1966.

Radio stations broadcasting music, for example, rock music, often seek to maximize "loudness" of their signals as reproduced by radio receivers tuned to their frequency. This is accomplished by maximizing the station's signal modulation. Signal modulation constraints imposed by the FCC limit the total energy the station can transmit so that the station does not interfere with other stations having the same broadcast frequencies in other areas of the country. Station efforts to attract a larger listening audience by operating above FCC imposed signal strength limits do occasionally occur but this practice is a risk since the FCC can impose fines or even revoke the station's license.

Competition among radio stations for listening audience share has lead to the common practice of clipping the composite signal to enhance loudness. If used sparingly, composite clippers do enhance loudness without adverse effect on the composite stereo signal. Over zealous clipping, however, distorts the main channel (50 hertz-53 kilohertz) modulation signal and also results in cross talk into the 53–100 kilohertz region.

One practice that radio stations have developed to utilize their entire allocated frequency range is to sublease a portion or portions of the unoccupied 47 kilohertz band above the composite stereo signal band for use by paging systems, beepers, and specialized communications such as private security systems. This additional authorized use of the radio station's allocated frequency band is generically referred to as a subchannel carrier authorization or SCA.

Spill over outside the main channel into the 47 kilohertz band (53–100 kilohertz) does not contribute to the information content of the radio broadcast but can adversely impact SCA communications. Additionally, the FCC regulated allowable power transmission covers the entire allocated frequency range so that spurious signals in the 53–100 kilohertz band, caused for example by excessive clipping, constitutes part of the station's allowable transmitted power output. If the radio station operates at maximum permissible power a small but meaningful percentage (5% or more) of the power is wasted due to spurious signal transmission.

DISCLOSURE OF THE INVENTION

The present invention provides a new apparatus and method for conditioning radio signals in one frequency range while preserving the quality of signals in a closely adjacent frequency range. The new apparatus and method allows radio stations to attenuate signals in a frequency range close to a composite stereo signal frequency band.

Apparatus constructed in accordance with the invention includes an attenuation circuit for attenuating signals in a frequency range while transmitting signals in an adjacent range, and a phase correction circuit for phase shifting signals transmitted by the attenuation circuit to avoid phase distortion of the transmitted signal. The method and apparatus of the present invention, applied to FM stereo radio broadcasts, provides a high quality composite stereo signal with an immediately adjacent low noise frequency band, which enhances the "loudness" of the stereo signal.

The process of eliminating noise imposes a frequency dependent phase delay on the main channel (50 hertz-53 kilohertz) composite stereo signal. The phase correction circuit cannot eliminate this phase delay but instead imposes a phase delay which combines with the attenuation circuit to correct the phase relationship of signals within the main channel composite stereo range.

Use of an attenuation circuit constructed in accordance with the invention may result in some amplitude distortion of the composite stereo signal. A circuit constructed in accordance with a preferred embodiment of the invention has an amplitude limiting circuit to reduce signal amplitude distortion that may result from use of the attenuation circuit.

A preferred attenuation circuit includes a plurality of series connected notch filters, each configured to selectively attenuate a specific frequency band or region. The notch filters may, for example, be designed to each attenuate a sub-region in the frequency range from 53 to 100 kilohertz. The combined effect of the plurality of the notch filters is to attenuate the signals in the 53 to 100 kilohertz range to a desired level; such as 60 dB below the maximum signal strength of the composite stereo in the 50 hertz to 53 kilohertz or main channel range.

Practice of the invention cleans up the 47 kilohertz wide region above the composite stereo signal for subchannel carrier authorization use. Even if the filtered frequency band is not used for SCA transmissions, signal reduction in the frequency band above 53 kilohertz allows for better utilization of the composite stereo band below 53 kilohertz. By filtering the signal before transmission a greater percentage of the broadcast power is in the information conveying region and is thus converted by the radio tuner to music or voice audio to make the radio station signal seem as loud as possible.

A circuit constructed in accordance with a preferred embodiment of the invention utilizes discrete, adjustable components. The frequency band of the notch filters, response to phase delay distortion, and threshold for signal amplitude limiting are adjustable. The components are tuned by monitoring signals transmitted through the circuit and then adjusting the components to produce a desired output.

The advantages, features, and operation of circuitry constructed in accordance with one embodiment of the invention are described in the "Best Mode for Practicing the Invention" which refers to the accompany drawings.

BEST MODE FOR PRACTICING THE INVENTION

Figure 1:
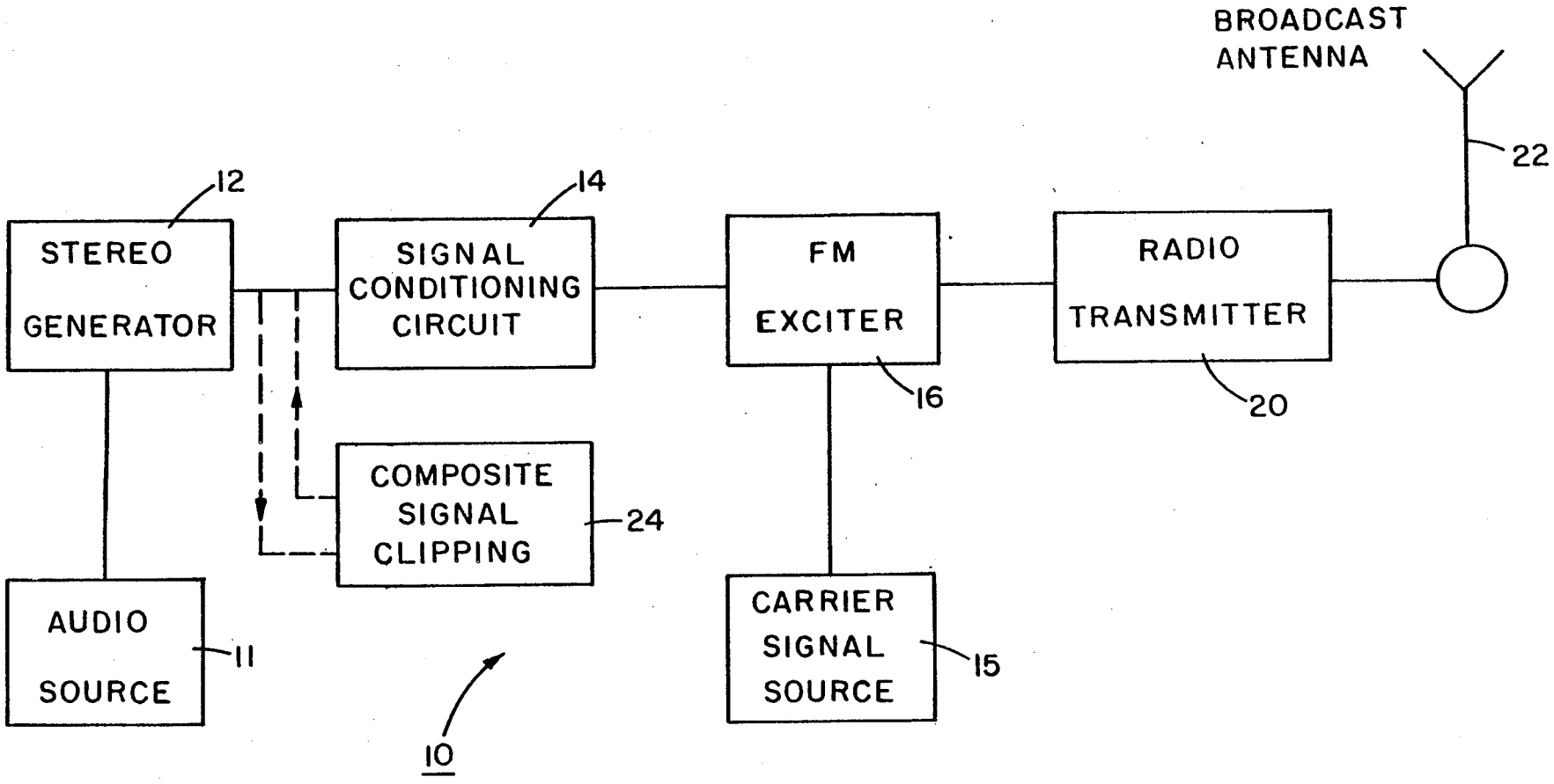
FIG. 1 is a schematic diagram of an FM stereo radio broadcasting system embodying the present invention.

Turning now to the drawings, FIG. 1 schematically depicts an FM stereo radio broadcasting system 10. The radio broadcasting system 10 receives input signals in the form of sound or electrical signals representative of sound and processes these signals to produce FM stereo broadcast signals. The broadcast signals are detected by remote radio receivers tuned to the system carrier frequency.

In the illustrated system 10, audible frequency electrical signals produced by an audio source 11 are fed to a stereo generator 12 which converts them into a stereophonically encoded signal called a composite stereo signal. The composite stereo signal is fed through a signal conditioning circuit 14 to an FM exciter 16 where the conditioned composite stereo signal is combined with a carrier signal. A carrier signal source 18 generates the carrier signal at a frequency centered in the frequency range allotted to the system 10. An output from the FM exciter 16 is fed to a radio transmitter 20 which energizes a broadcast antenna 22 with a stereophonically encoded FM signal.

Since composite stereo clipping is often used to enhance loudness the FIG. 1 depiction includes a composite signal clipping circuit 24. The circuit 24 is shown as optional by the dotted line connection of the clipping circuit 24 to an output from the stereo generator 12. If used, the clipping circuit 24 clips modulation signals above a threshold value and this increases the perceived loudness of the transmitted signal.

A radio receiver antenna at a remote receiving location picks up the broadcast signals and produces corresponding input signals. After the input signals are processed, a tuner extracts right and left stereo channel signals from the composite stereo signal. These audio frequency signals are amplified to levels to drive speakers for converting audio range electrical signals into mechanical air movements detected by a listener.

Figure 2:
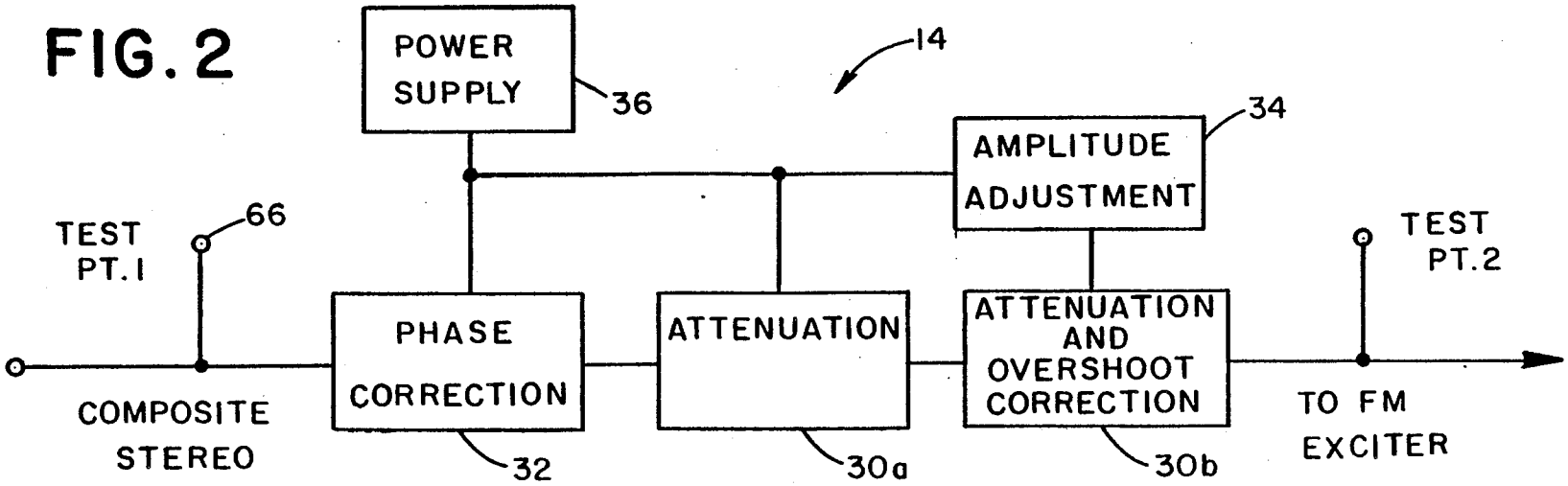
FIG. 2 is a block diagram of a signal conditioning circuit used in the FIG. 1 radio broadcasting system.
Figure 7:
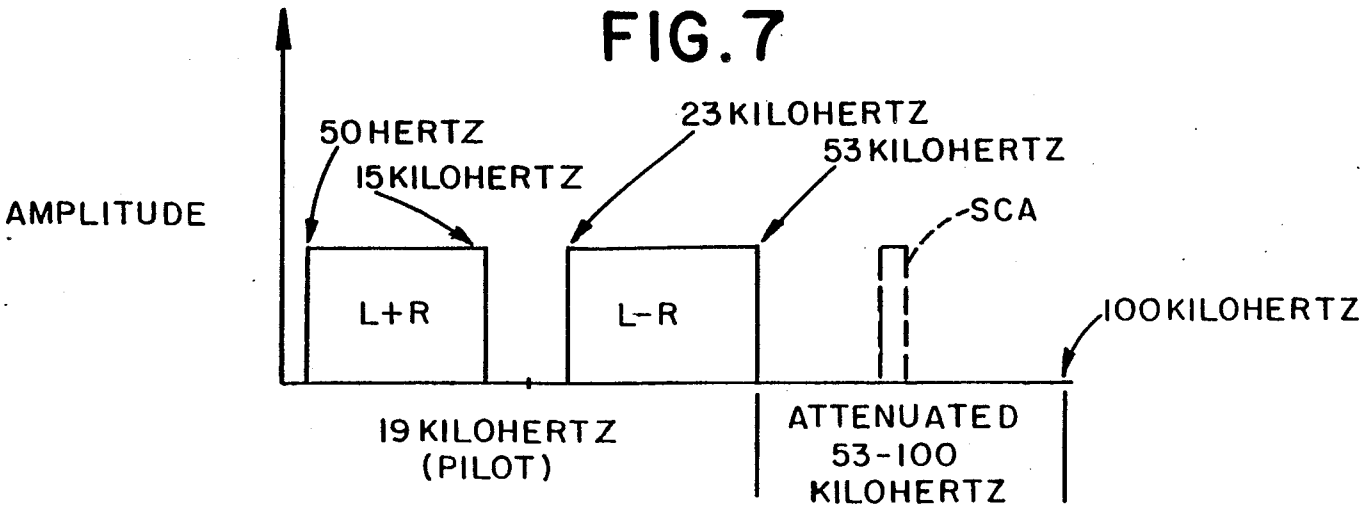
FIG. 7 is a schematic depiction of a modulation frequency utilization by an FM radio station.

The signal conditioning circuit 14 includes two attenuation stages **30*a*, 30*b* (FIG. 2) that combine to attenuate radio signals within a specific frequency range while passing radio signals outside the frequency range. In the disclosed and preferred embodiment of the invention the attenuation stages 30*a*, 30*b* attenuate signals received from the stereo generator 12 in the modulation frequency range from 53 kilohertz to 100 kilohertz (FIG. 7**), i.e., the frequency range above the main channel composite stereo signal.

Before reaching the attenuation stages **30*a*, 30*b* the composite stereo signals pass through a phase correction circuit 32. In addition to attenuating frequencies above 53 kilohertz, the attenuation stages 30*a*, 30*b* impose an unwanted frequency dependent phase shift on signals within the 50 hertz to 53 kilohertz frequency range. The phase correction circuit 32 compensates for this phase shift by imposing an additional phase shift that counteracts the phase shift imposed by the attenuation stages 30*a*, 30*b***.

The second attenuation stage **30*b* clips main channel signals by an amount to correct for any overshoot in the main channel signals caused by the two attenuation stages 30***a*, 30*b*. An amplitude adjustment circuit 34 allows the user to adjust the amount of clipping effective by the secured attenuation stage 30*b*.

Figure 4:
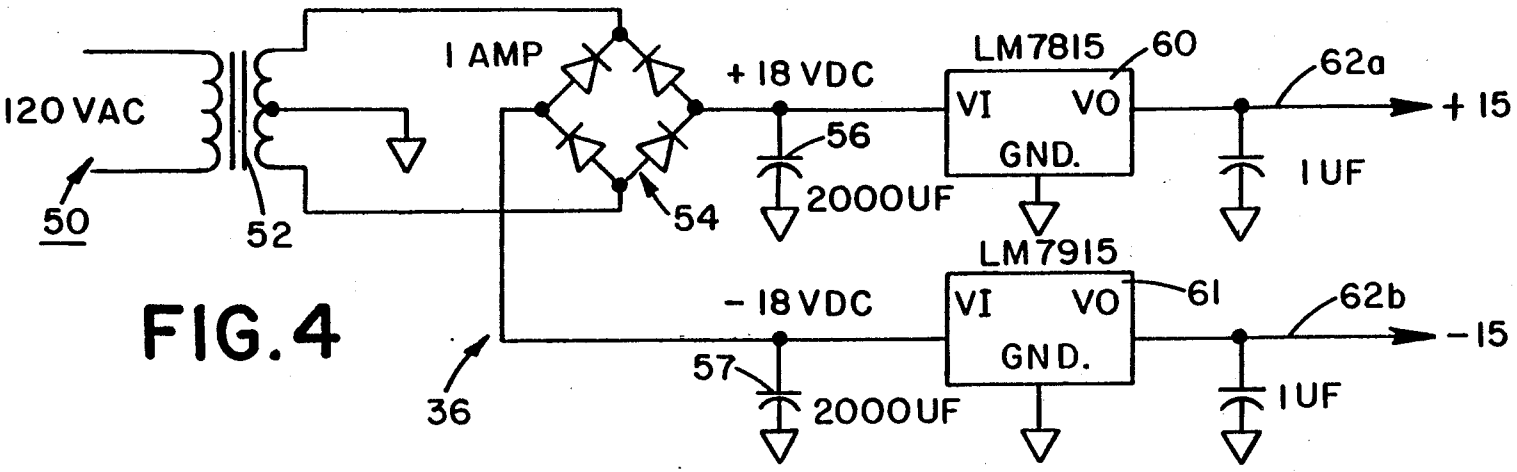
FIG. 4 is a circuit diagram of a power supply for energizing the signal conditioning circuit depicted in FIGS. 3A and 3B.

The amplitude adjustment circuit 34, attenuation circuit 30*a*, 30*b* and phase correction circuit 32 are each connected to a power supply 36 (FIG. 4) that produces regulated ±15 volt direct current signals. A 120 volt alternating current input 50 is coupled to a transformer 52 having an output coupled across a full wave rectifying bridge circuit 54. The transformer *52* steps down the voltage from 120 volts and the rectifier 54 produces a pulsed DC signal of approximately ±18 volts DC. This pulsed signal is filtered by two capacitors 56, 57 and then coupled to two voltage regulators 60, 61 for providing ±15 volt regulated DC outputs 62*a*, 62*b*.

Figure 3A:
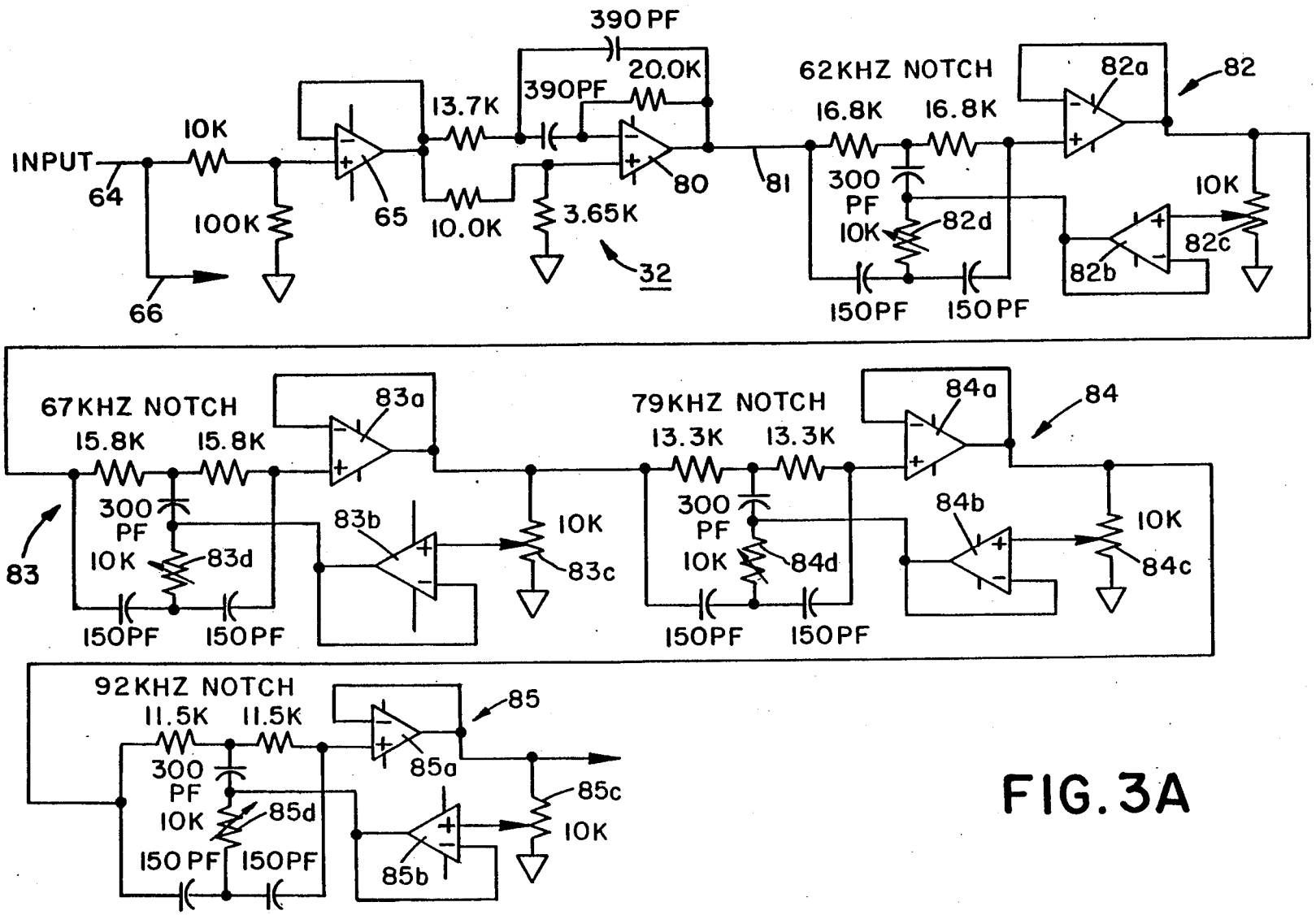
FIG. 3A is a circuit diagram of one portion of the signal conditioning circuit constructed in accordance with the present invention.
Figure 6:
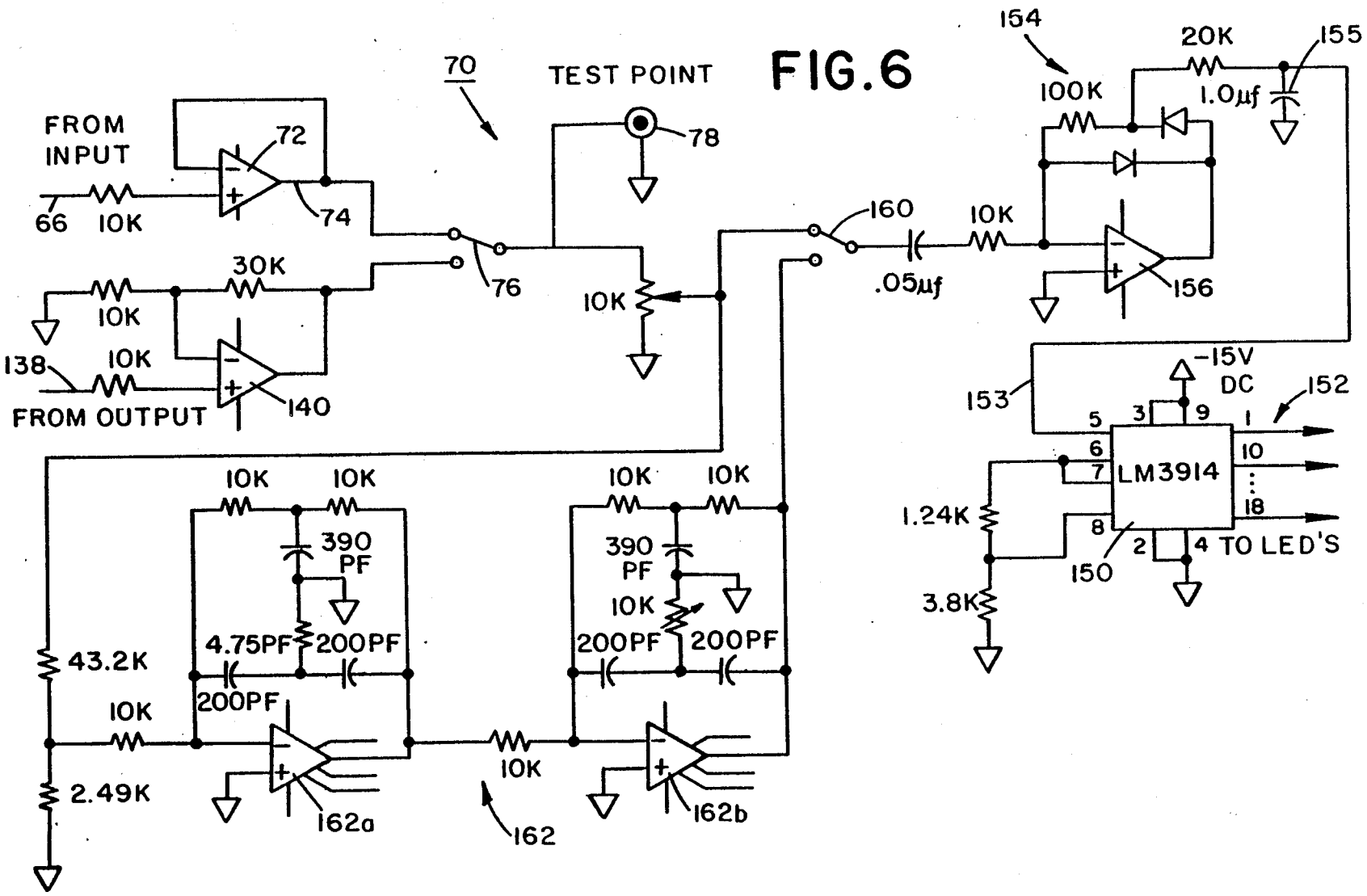
FIG. 6 is a circuit diagram of a circuit for monitoring signals transmitted to and from the signal conditioning circuit portions of FIGS. 3A and 3B.
Figure 8:
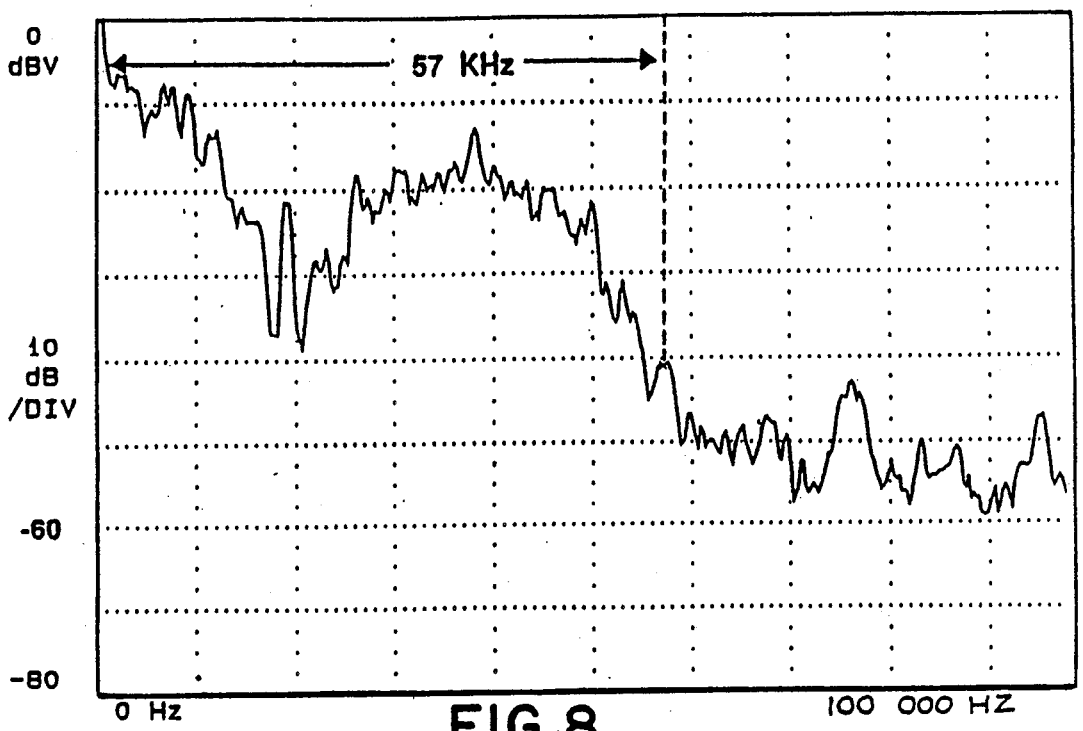
FIG. 8 is a graph showing relative amplitudes of frequency modulation signals in the frequency range 0 to 100 kilohertz before signal conditioning.

Turning now to FIG. 3A, a composite stereo signal from the stereo generator 12 is coupled as an input 64 to a buffer amplifier 65 that buffers signals from the stereo generator as they are transmitted to the phase correction circuit 32. A test output 66 is coupled to a monitoring circuit 70 (FIG. 6) to enable an FM radio station engineer to monitor the signal conditioning effect of the signal conditioning circuit 14. Signals from the stereo generator are coupled to a buffer amplifier 72 having an output 74 coupled to a test point connector 78 through a switch 76. An output from the connector 78 can be used to monitor the composite stereo signal input to the signal conditioning circuit 14 on a signal analyzer or plotter. The graph of FIG. 8 is a representative output from a plotter indicating relative amplitude of signals in the range 0–100 kilohertz before processing by the signal conditioning circuit.

Returning to the signal conditioning circuit, an output from the buffer amplifier 65 (FIG. 3A) is coupled to the phase correction circuit 32 which delays signals passing through the conditioning circuit to compensate for phase distortion caused by subsequent signal processing in the two attenuation stages 30*a*, 30*b*. The circuit 32 phase shifts unattenuated signals in the main channel, i.e., in the band 50 hertz to 53 kilohertz, in a manner which depends upon their frequency. When these main channel signals are again phase shifted as they pass through the attenuation stages 30*a*, 30*b* a correct phase relation between signals in the main channel results.

The phase correction circuit 32 is constructed from an operational amplifier 80 configured as an all pass filter which passes all input frequencies to an output 81. The all-pass filter or phase shifting filter has a constant amplitude response. The values of components coupled to the operational amplifier 80 to configure the all-pass filter are chosen in accordance with a technique described in the text entitled "Reference Data for Radio Engineers," 6th edition, 3rd printing published in 1979 by the Howard W. Sams & Co., Inc. The section of this text at pages 10–19 through 10–21 relating to "all-pass filters" is incorporated herein by reference.

A phase compensated composite stereo signal at the output 81 is coupled to a series of eight notch filters 82–89 (FIGS. 3A, 3B) that in combination form the attenuation stages 30*a*, 30*b*. Each of the notch filters 82–89 is designed to most strongly attenuate signals centered about a specific notch frequency.

As seen in FIG. 3A, the first notch filter 82 includes two operational amplifiers 82*a*, 82*b* and discrete circuit components chosen to center the notch frequency at a specific point within the 53–100 kilohertz band. The filter 82, for example, most strongly attenuates signals centered about a 62 kilohertz signal.

The attenuation of signals in a band or zone near the 62 kilohertz center or notch frequency is adjusted by varying the setting of an adjustable potentiometer 82*c* coupled to the amplifier 82*b*. By adjusting the potentiometer 82*c* the band of attenuated signals can be narrowed or widened.

The filter 82 also includes a potentiometer 82*d* for adjusting the notch frequency. By adjusting the setting of the potentiometer 82*d* the 62 kilohertz nominal notch frequency can be shifted both above and below 62 kilohertz.

The construction and operation of the notch filter 82 is described in a publication entitled "Audio IC OpAmp Application (Second Edition)" by Walter G. Jung, Howard W. Sams & Co., Inc., publisher. Specifically Chapter 5, Section 5.35 at page 159 of this edition describes a "twin-T notch filter". The description of the "twin-T notch filter" from the Audio IC Op-Amp Application's text is incorporated herein by reference.

Figure 3B:
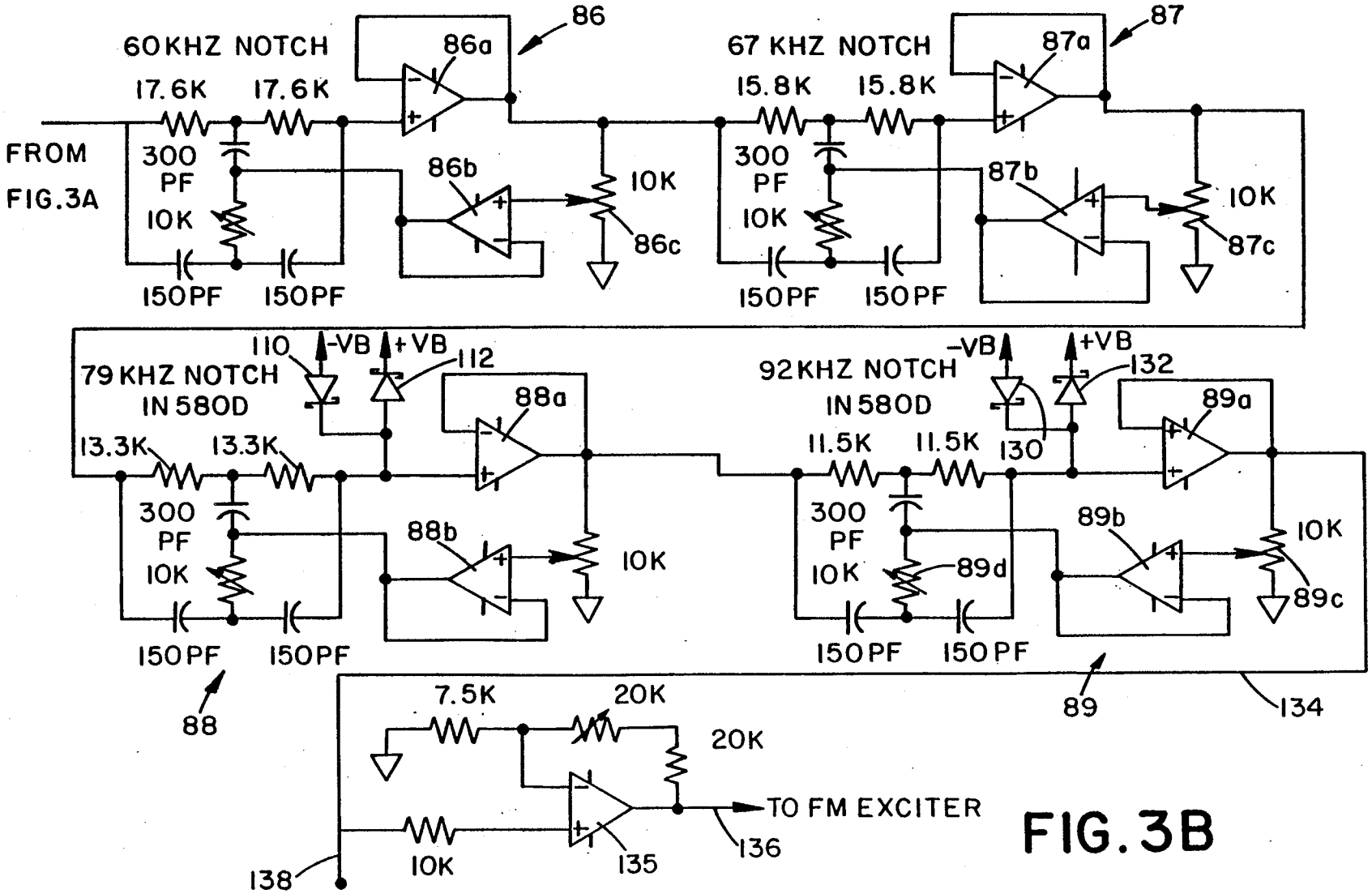
FIG. 3B is a circuit diagram of a second portion of the signal conditioning circuit.

The additional seven filters 83–89 are serially connected to the filter 82 and are adjusted to attenuate signals in other bands within the frequency range from 53 kilohertz to 100 kilohertz. These subsequent filters 83–89 are similarly constructed, i.e., they each include two operational amplifiers, two adjustable potentiometers and fixed value resistors and capacitors. In FIGS. 3A and 3B components of the filters are similarly identified so that, for example, the filter 83 is identified as having operational amplifiers 83*a*, 83*b* and adjustable potentiometers 83*c*, 83*d*. Similar identifying conventions are adopted for the filters 84–89.

Figure 5:
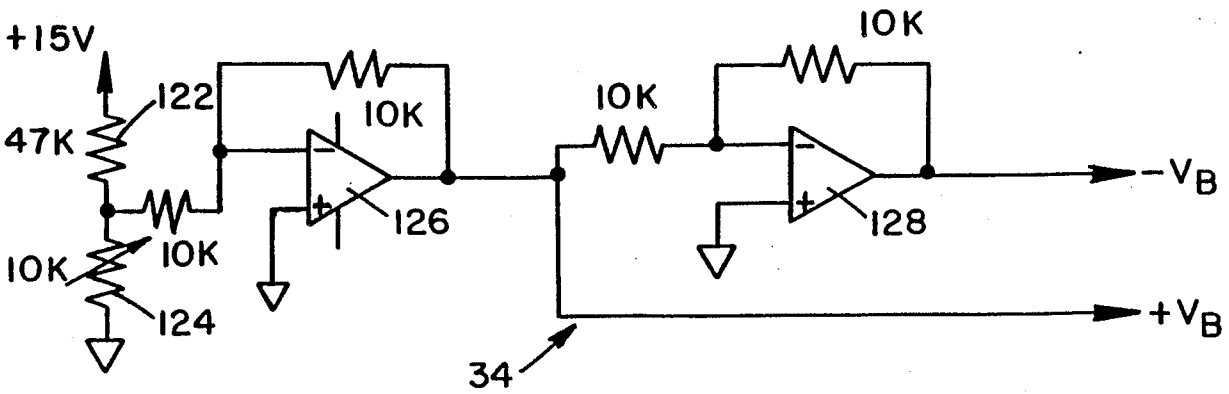
FIG. 5 is a circuit diagram of an amplitude adjustment circuit for regulating modulation signal amplitude.

As modulation signals in the 50 hertz-53 kilohertz range pass through the filters 82–89 some amplitude distortion may occur. If not compensated this could result in modulation signals that exceeds FCC regulated modulation power levels. To compensate and adjust for amplitude overshoot caused by the filters 82–89, two Schottky diodes 110, 112 are coupled to the notch filter 88. The Schottky diodes 110, 112 clip modulation signals at the non-inverting (+) input to the operational amplifier 88*a* that exceed adjustable threshold voltages. The magnitude of the threshold voltage clipped by the diodes 110, 112 is controlled by the amplitude limiting circuit 34 (FIG. 5) that defines the size of input voltages $-V_B$, $+V_B$ coupled to the Schottky diodes 100, 112.

The amplitude limiting circuit 34 includes a voltage divider constructed from the combination of a fixed value resistor 122 and a variable potentiometer 124. The voltage divider scales the +15 volt output from the power supply to provide an adjustable amplitude control voltage. The control voltage is buffered by a buffer amplifier 126 and a positive output $+V_B$ from the amplifier 126 is coupled to the Schottky diode 112. The Schottky diode 112 breaks down if the voltage across the diode exceeds a threshold level. This limits the input voltage to the operational amplifier 88*a* from going lower than a specified negative voltage. The $+V_B$ output from the buffer amplifier 126 is also coupled to an inverter 128 having unitary gain which provides an output $-V_B$ coupled to the Schottky diode 110. This limits the size of positive voltages at the non-inverting (+) input to the amplifier 88*a*.

The last notch filter 89 (FIG. 3B) also has two Schottky diodes 130, 132 coupled to the non-inverting input (+) of the operational amplifier 89*a*. The anode and cathode of these diodes 130, 132 are coupled to the $-V_B$ and $+V_B$ signals from the amplitude limiting circuit 34 and operate to limit the amplitude of signals passing through the last filter 89.

An output 134 from the last of the series of notch filters 89 passes through a variable gain amplifier 135 to an output 136 coupled to the FM exciter 16 (FIG. 1). The output 134 can also be monitored by the radio station engineer to determine the effect the signal conditioning circuit 14 has had on the composite stereo signal. Signals at the output 134 are coupled to the monitoring circuit 70 by a branch connection 138. A buffer amplifier 140 coupled to the branch connection 138 has an output that can be coupled to the test point connector 78 via the switch 76.

FIG. 8 depicts the modulation frequency amplitudes at the test point 78 prior to signal conditioning. Moderate modulation signal clipping has been used to enhance "loudness" and it is seen that although the modulation signal in the frequency range above 57 kilohertz is less than the composite stereo signal below 57 kilohertz clipping causes the higher frequency contribution to form a significant part of the total modulation signal. Specifically, modulation frequencies in the band from 57 kilohertz to 100 kilohertz have amplitudes greater than 60 db of the maximum composite stereo signal amplitudes in the band 50 hertz-53 kilohertz.

Figure 9:
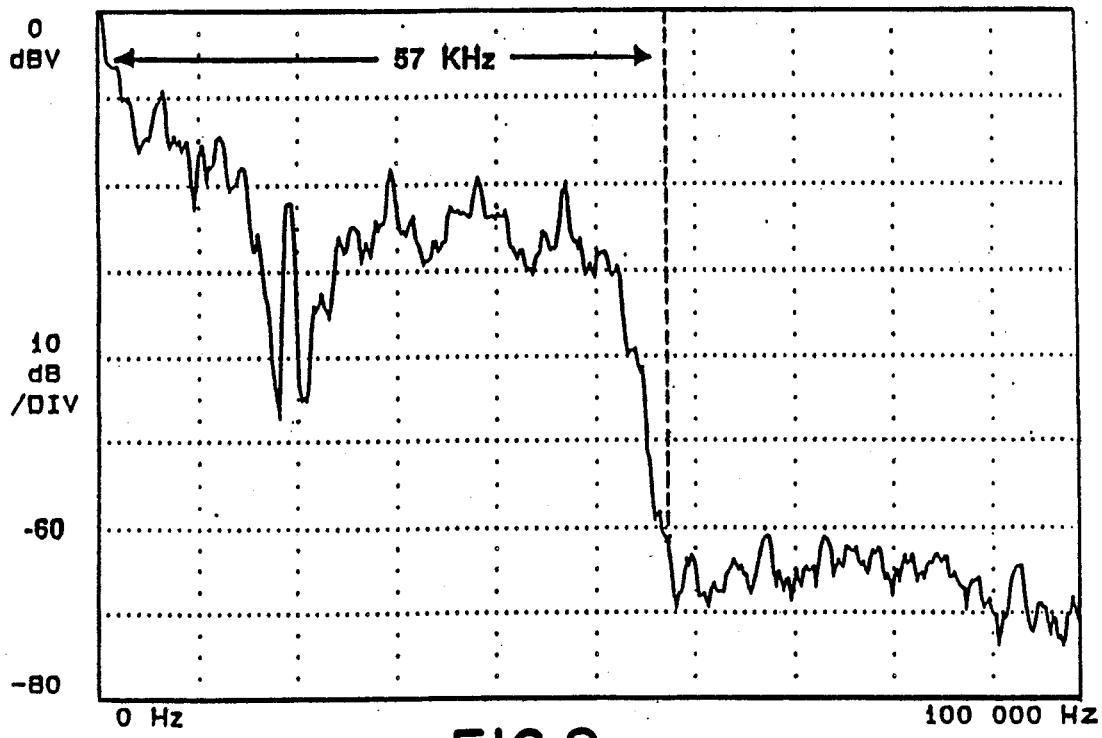
FIG. 9 is a graph showing relative amplitude of frequency modulation signals in the frequency range 0 to 100 kilohertz after signal conditioning by the signal conditioning circuit of FIGS. 3A and 3B.

FIG. 9 shows the modulation signal at the output 134 from the signal conditioning circuit corresponding to the input depicted in FIG. 8. The signal amplitude in the 57 kilohertz to 100 kilohertz range is attenuated to 60 db below the maximum amplitude signal within the 50 hertz-53 kilohertz range.

Figure 10:
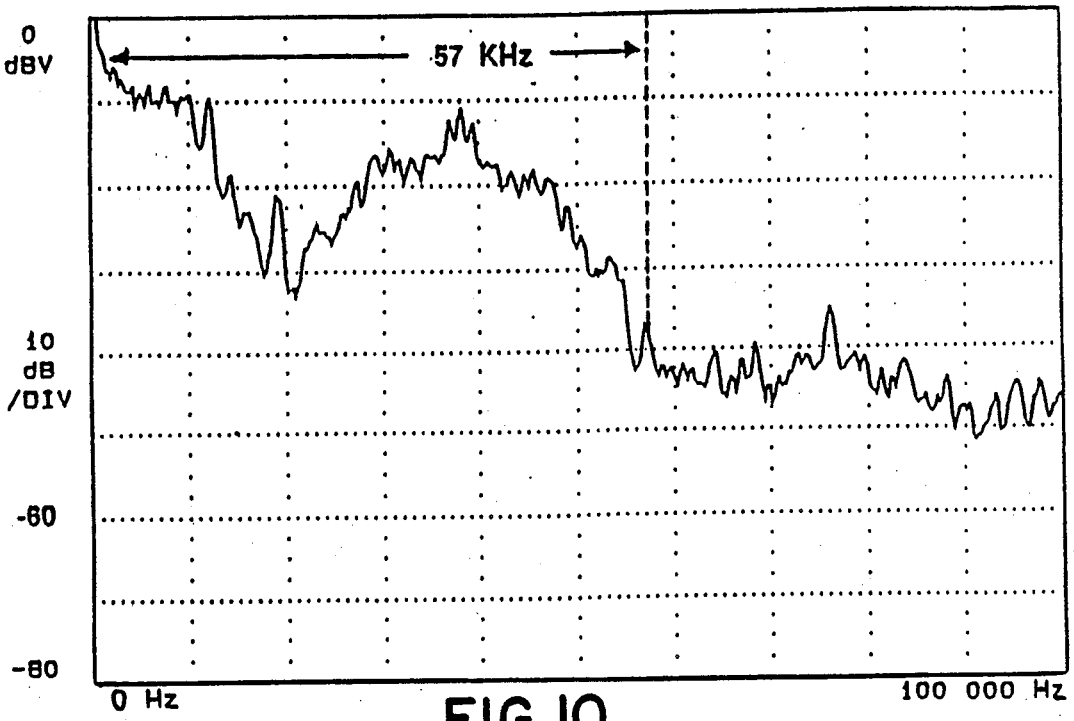
FIG. 10 is a graph showing relative amplitudes of frequency modulation signals after excessive clipping and no signal conditioning.
Figure 11:
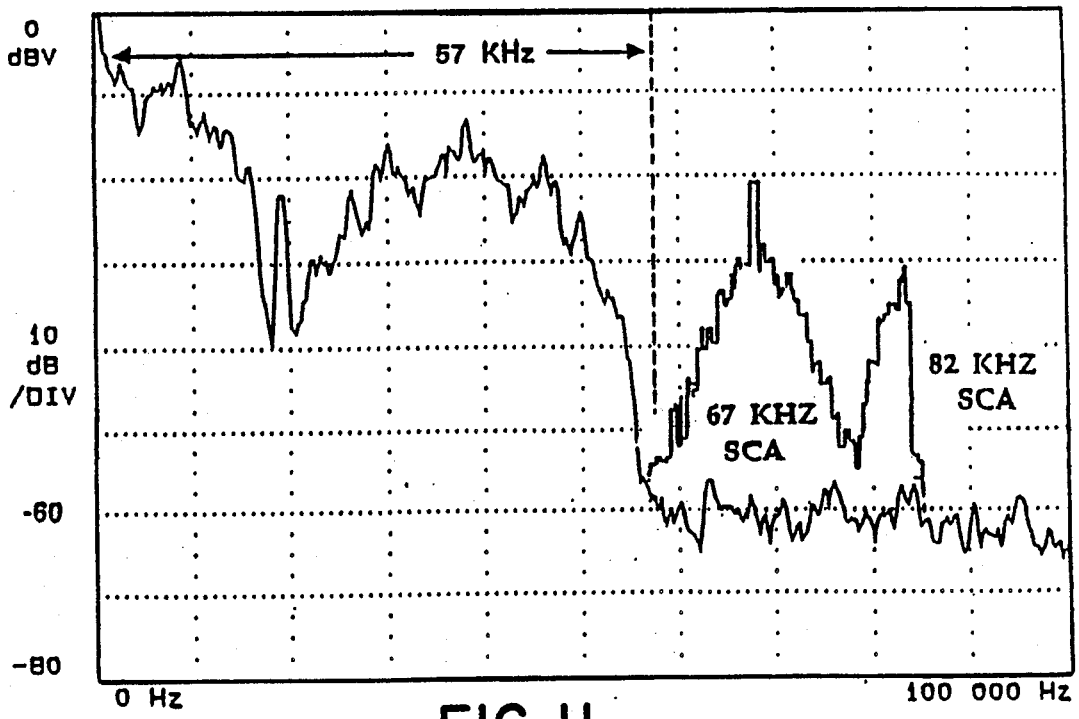
FIG. 11 is a graph showing relative amplitudes of frequency modulation signals with excessive clipping and after signal conditioning by the signal conditioning circuit of FIGS. 3A and 3B; this figures also includes a graph showing representative SCA modulation signals to show that once noise in the region above 53 kilohertz is attenuated this region can be used for SCA communications.

FIGS. 10 and 11 show signals in the frequency range 0–100 kilohertz where excessive clipping has been used. FIG. 10 depicts the input signal before signal conditioning. Excessive clipping has caused the signal in the 57 kilohertz-100 kilohertz range to be larger than the same frequency signal in FIG. 8. FIG. 11 depicts the modulation signal after it has passed through the signal conditioning circuit 14. Attenuation in the range 57 kilohertz-100 kilohertz has again reduced signal amplitude to −60 db of the maximum signal strength of the composite stereo signal.

As seen in FIG. 11 the attenuation that occurs due to use of the signal conditioning circuit 14 would allow leasing of the 53 kilohertz-100 kilohertz region for SCA use without a reduction in composite stereo signal modulation amplitude even though strong clipping of the composite stereo signal has been used.

A properly calibrated signal analyzer can be used to monitor the output at the test point connector 78 and confirm that the signal conditioning circuit 14 has attenuated signals in the frequency range 53 kilohertz to 100 kilohertz. Some radio stations may not be adequately equipped with test equipment, however, to monitor these signals. The monitoring circuit 70 includes a means for supplying a visual indication concerning the operation of the signal conditioning circuit 14.

An integrated circuit 150 is included in the monitoring circuit 70 for activating a series of light emitting diodes coupled to outputs 152 from the integrated circuit 150. The number of activated LEDs is proportional to the magnitude of a signal at an analog input 153 to the integrated circuit 150. The higher the voltage at the input 153, the more LEDs are activated.

The analog signal at the input 153 to the integrated circuit 150 is coupled to the output of a peak detector 154. The output voltage from the peak detector 154 is based upon the charge on a capacitor 155 coupled to the output from an operational amplifier 156. The detector 154 provides an output signal corresponding to the average magnitude of a multiple frequency signal appearing at the inverting input (−) to the operational amplifier 156.

A switch 160 having an output coupled to the peak detector 154 dictates the source of signals transmitted to the peak detector. In the position shown in FIG. 6, the switch 160 transmits the signal appearing at the test point connector 78 to the peak detector. With the switch 160 in this position the peak detector 154 senses the modulation signal in the entire range from 0 to 100 kilohertz at either the input 64 (before signal conditioning) or at the output 138 from the last notch filter 89.

When the switch 160 is switched to a second position, the modulation signals pass through a band pass filter 162 centered at 76 kilohertz before reaching the peak detector. With the switch 160 in this position, the radio station engineer views an average value of signals centered in the attenuated region, i.e., signals centered at 76 kilohertz. As seen by reference to FIGS. 8–11, the signal amplitude centered at 76 kilohertz is significantly less than the amplitude in the composite stereo signal in the range from 50 hertz to 53 kilohertz. When the peak detector 54 is monitoring an average signal in the entire 0–100 kilohertz frequency range, the signal amplitude is greater than the signal passing through the filter 162. To take into account the difference in amplitudes, the filter 162 includes two operational amplifiers **162*a*, 162*b* that amplify the signals from the test point connector 78** in addition to attenuating signals.

By coordinating the setting of the two switches 76, 160, the radio station engineer can monitor performance of the signal conditioning circuit 14. By adjusting the switch 160 to directly couple the test point connector 78 to the peak detector 154 and then toggling the switch 76 back and forth, the radio station engineer can monitor the average value of the modulation signal in the entire range from 0 to 100 kilohertz before and after filtering. In instances in which clipping is used, this can provide an indication of the beneficial impact the signal conditioning circuit 14 has on the frequencies greater than 53 kilohertz.

When the switch 160 is switched to couple signals from the test point connector 78 through the filter 162 to the peak detector 154, the switch 76 compares the 76 kilohertz signal before and after filtering. This allows the radio station to confirm that the frequencies above the main channel signal have indeed been attenuated.

While the present invention has been described with a degree of particularity, it is the intent that the invention include all modifications and alterations from the disclosed design falling within the spirit or scope of the appended claims.

I claim:

1. Signal conditioning apparatus for use in frequency modulating a communications broadcast carrier signal comprising:

(a) an attenuation circuit for attenuating modulation radio signals within a frequency range and for transmitting modulation radio signals outside the frequency range; and (b) a phase correction circuit coupled to the attenuation circuit to effect a phase adjustment on modulation radio signals transmitted by the attenuation circuit outside the frequency range to reduce phase distortion imposed on the modulation signals outside the frequency range due to transmission of said signals by the attenuation circuit.

2. The apparatus of claim 1 additionally comprising an amplitude limiting circuit for limiting radio signal amplitude of signals transmitted by the signal conditioning apparatus.

3. The apparatus of claim 1 wherein the attenuation circuit comprises a plurality of filter circuits connected in series and wherein one or more of the plurality of filter circuits can be tuned to adjust the frequency that the one or more filters most strongly attenuates.

4. The apparatus of claim 2 wherein the amplitude limiting circuit comprises a diode that clips the radio signal if the radio signal exceeds a threshold amplitude.

5. The apparatus of claim 1 wherein the attenuation circuit comprises a plurality of notch filters coupled in series which in combination attenuate radio signals having frequencies within the frequency range.

6. The apparatus of claim 5 wherein each one of the plurality of notch filter circuits includes means for tuning signal attenuation to concentrate attenuation to subrange with within the frequency range.

7. A method for use in broadcasting a signal comprising the steps of:

(a) generating a composite stereo signal having a left plus right channel signal component and a left minus right channel signal component;

(b) attenuating signals above a cutoff frequency by passing the composite stereo signal through a series of notch filters;

(c) passing an output from the notch filters through a delay circuit to impose frequency sensitive delays on the composite stereo signal and correct for phase delays imposed by the notch filters; and (d) coupling the composite stereo signal to a transmitter for broadcast.

8. The method of claim 7 comprising the additional step of attenuating signals where amplitude is distorted by filtering of the composite stereo signal.

9. Broadcast signal processing apparatus for attenuating communications signals in a specific frequency range within a communications frequency band comprising:

(a) a signal attenuator comprising a filter circuit tuned to attenuate most strongly frequencies above a composite stereo signal band; and (b) a phase correction circuit coupled to an output from the filter circuit to effect a phase shift on composite stereo signals transmitted by the filter circuit to reduce phase distortion imposed on the composite signals caused by passage of the signals through the filter circuit.

10. The broadcast signal processing apparatus of claim 9 additionally comprising an amplitude limiting circuit for attenuating signals that exceed a threshold amplitude subsequent to passage of the signals through the filter circuit.

11. The apparatus of claim 9 wherein the filter circuit comprises a plurality of filter circuits connected in series and wherein one or more of the plurality of filter circuits can be tuned to adjust the frequency that the one or more filters most strongly attenuates.

12. The apparatus of claim 10 wherein the amplitude limiting circuit comprises a diode that clips the signal if the signal exceeds a limit.

13. The apparatus of claim 9 wherein the filter circuit comprises a plurality of notch filters coupled in series to span the specific frequency range.

* * * * *